US007891797B2

(12) United States Patent
Chikamoto et al.

(10) Patent No.: US 7,891,797 B2
(45) Date of Patent: Feb. 22, 2011

(54) INKJET HEADS

(75) Inventors: Tadanobu Chikamoto, Nagoya (JP); Hiroshi Taira, Ichinomiya (JP); Yoshirou Kita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 769 days.

(21) Appl. No.: 11/692,040

(22) Filed: Mar. 27, 2007

(65) Prior Publication Data

US 2007/0229634 A1 Oct. 4, 2007

(30) Foreign Application Priority Data

Mar. 31, 2006 (JP) ..... 2006-096355

(51) Int. Cl.
*B41J 2/175* (2006.01)
*B41J 2/17* (2006.01)

(52) U.S. Cl. ..... 347/93; 347/94

(58) Field of Classification Search ..... None
See application file for complete search history.

(56) References Cited

U.S. PATENT DOCUMENTS

| | | | | |
|---|---|---|---|---|
| 5,943,079 | A * | 8/1999 | Yoshida | 347/94 |
| 6,109,736 | A * | 8/2000 | Miyata et al. | 347/68 |
| 6,332,671 | B1 * | 12/2001 | Takahashi et al. | 347/68 |
| 6,394,589 | B1 | 5/2002 | Willus et al. | |
| 6,695,442 | B2 * | 2/2004 | Kitahara | 347/92 |
| 7,229,159 | B2 * | 6/2007 | Chikamoto et al. | 347/65 |
| 7,278,710 | B2 * | 10/2007 | Hirota et al. | 347/54 |
| 2005/0078157 | A1 * | 4/2005 | Suzuki | 347/93 |
| 2005/0140754 | A1 | 6/2005 | Hirota et al. | |
| 2005/0157104 | A1 | 7/2005 | Hirota et al. | |
| 2005/0285909 | A1 | 12/2005 | Murata et al. | |

FOREIGN PATENT DOCUMENTS

| | | | |
|---|---|---|---|
| EP | 0863007 | A2 | 9/1998 |
| EP | 0972643 | A2 | 1/2000 |
| EP | 1010533 | A2 | 6/2000 |
| EP | 1255307 | A1 | 11/2002 |
| EP | 1493840 | A2 | 1/2005 |
| EP | 1547775 | A1 | 6/2005 |
| EP | 1707365 | A2 | 10/2006 |
| JP | 2003-515475 | T | 5/2003 |

(Continued)

OTHER PUBLICATIONS

European Patent Office, European Search Report for Related EP Application No. 07251271 dated Aug. 14, 2008.

(Continued)

*Primary Examiner*—Omar Rojas
(74) *Attorney, Agent, or Firm*—Baker Botts L.L.P.

(57) ABSTRACT

An inkjet head includes a flow channel member comprising a first orifice which opens in a first direction, in which ink flows into the first orifice. The flow channel member also includes a second orifice which opens in a second direction opposite to the first direction, in which ink flows out from the second orifice, and an ink flow channel formed therein, in which the ink flow channel extends from the first orifice to the second orifice. Moreover the inkjet head includes a flexible film which is attached to the flow channel member, and the flexible film seals the ink flow channel.

13 Claims, 9 Drawing Sheets

FOREIGN PATENT DOCUMENTS

| | | | |
|---|---|---|---|
| JP | 2005169839 | | 6/2005 |
| JP | 2005-186375 | A | 7/2005 |
| JP | 2006-044225 | A | 2/2006 |

OTHER PUBLICATIONS

Japan Patent Office; Notice of Reasons for Rejection in Japanese Patent Application No. 2006-096355 (counterpart to the above-captioned U.S. Patent application) mailed Mar. 16, 2010.

* cited by examiner

INKJET HEADS

CROSS REFERENCE TO RELATED APPLICATION

The present application claims priority from Japanese Patent Application No. 2006-096355, which was filed on Mar. 31, 2006, the disclosure of which is incorporated herein by reference in its entirety.

FIELD OF THE INVENTION

The present invention relates generally to inkjet heads which eject ink onto a recording media, such as paper.

BACKGROUND OF THE INVENTION

An inkjet printer which includes an inkjet head for ejecting ink from a nozzle to a paper is known in the art. The known inkjet head includes four actuator units, a head body having a flow channel unit in which a plurality of individual ink flow channels are formed from a manifold to the nozzle through a pressure room in a region opposed to each actuator unit, and a reservoir unit for storing ink which is to be supplied to the manifold. Each actuator unit selectively changes a fluid capacity of the pressure room in the individual ink: flow channel, thereby applying ejecting energy to ink which is in the pressure room. Thus, ink is ejected from the nozzle in communication with the pressure room, thereby printing an image to the paper. At this time, ink in the manifold flows into the individual ink flow channel based on the amount of the ink ejected from the nozzle, and ink in the reservoir unit flows into the manifold.

In the known inkjet head, the actuator unit changes the capacity of the pressure room to apply ejecting energy to the ink in the pressure room, thereby ejecting the ink from the nozzle. At that time, the pressure applied to the ink in the pressure room is transferred to the ink in the ink flow channel of the manifold and the reservoir unit. Because the ink flow channel of the manifold and the reservoir unit is in fluid communication with the plurality of pressure rooms, the vibration also is transferred to the ink in the other pressure rooms, such that there is fluid cross-talk. When the pressure of the other pressure rooms changes due to the fluid cross-talk, ink ejecting characteristics, such as an ink ejecting velocity or an amount of droplets in the pressure room where the change in pressure occurs, also change, which decreases the quality of printing.

SUMMARY OF THE INVENTION

Therefore, a need has arisen for inkjet heads which overcome these and other shortcomings of the related art. A technical advantage of the present invention is that fluid cross-talk may be eliminated or substantially reduced by using a flexible, e.g., film, wall for an ink flow channel which is formed in a flow channel member.

According to an embodiment of the present invention, an inkjet head comprises a first flow channel member comprising a first orifice which opens in a first direction, in which ink flows into the first orifice. The first flow channel member also comprises a second orifice which opens in a second direction opposite to the first direction, in which ink flows out from the second orifice, and a first ink flow channel formed therein, in which the first ink flow channel extends from the first orifice to the second orifice. The inkjet head also comprises a filter which is disposed in the first flow channel member and extends in a direction substantially perpendicular to the first direction along the first ink flow channel, and the filter is configured to filter ink which passes through the first ink flow channel. Moreover, the inkjet head comprises a first flexible film which is attached to the first flow channel member and extends in a direction substantially perpendicular to the first direction, and the first flexible film seals the first ink flow channel. In addition, the inkjet head comprises a second flow channel member comprising a second ink flow channel which is configured to be in fluid communication with the first ink flow channel via the second orifice.

According to another embodiment of the present invention, an inkjet head comprises a flow channel member comprising a first orifice which opens in a first direction, in which ink flows into the first orifice. The flow channel member also comprises a second orifice which opens in a second direction opposite to the first direction, in which ink flows out from the second orifice, and an ink flow channel formed therein, in which the ink flow channel extends from the first orifice to the second orifice. Moreover the inkjet head comprises a flexible film which is attached to the flow channel member, and the flexible film seals the ink flow channel.

Other objects, features, and advantage will be apparent to persons of ordinary skill in the art from the following detailed description of the invention and the accompanying drawings.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

DETAILED DESCRIPTION OF EMBODIMENTS

Embodiments of the present invention, and their features and advantages, may be understood by referring to FIGS. 1-9B, like numerals being used for like corresponding parts in the various drawings.

Figure 1:
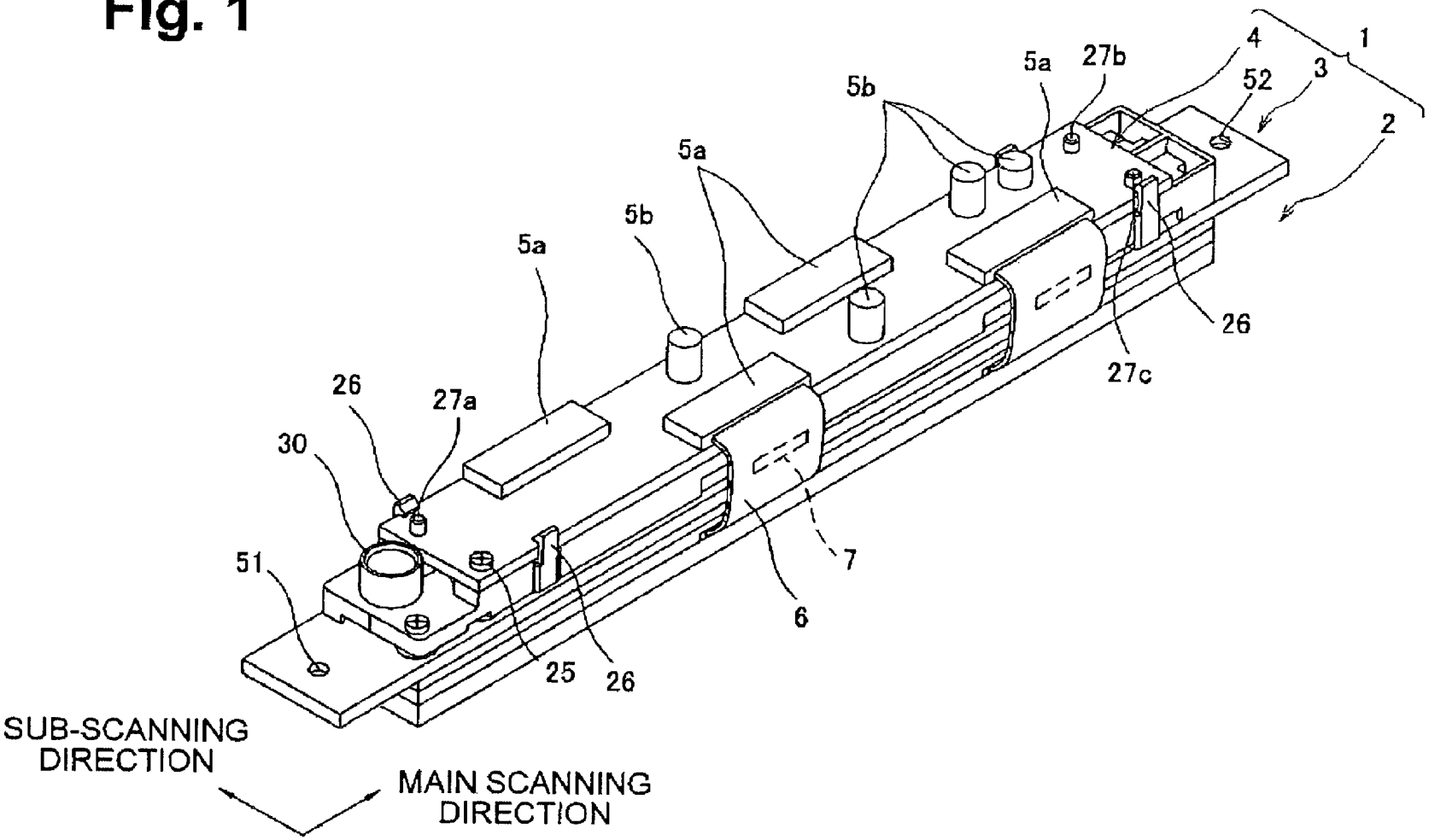
FIG. 1 is a perspective view of an inkjet head, according to an embodiment of the present invention.

Referring to FIG. 1, an inkjet head 1 according to an embodiment of the invention is depicted. The inkjet head 1 may have a longitudinal shape in a main scanning direction. The inkjet head may comprise a head body 2 which opposes a paper, a reservoir unit 3 for storing ink, and a substrate 4 on which electronic components, such as a connector 5*a* and a capacitor 5*b*, are mounted. Four Flexible Printed Circuits ("FPC's") 6 may be attached on the top surface of the head body 2 and may extend between the head body 2 and reservoir unit 3 in an upward direction. One end of FPC 6 may be connected to an actuator unit 21, and the other end of FPC 6 may be connected to the connector 5*a* of the substrate 4. In addition, a driver IC 7 may be mounted in the FPC 6 between the actuator unit 21 and the substrate 4, such that the FPC 6 is electrically connected to the substrate 4 and the driver IC 7, and the FPC 6 may transmit an image signal outputted from the substrate 4 to the driver IC 7, and may transmit a driving signal outputted from the driver IC 7 to the actuator unit 21.

Figure 2:
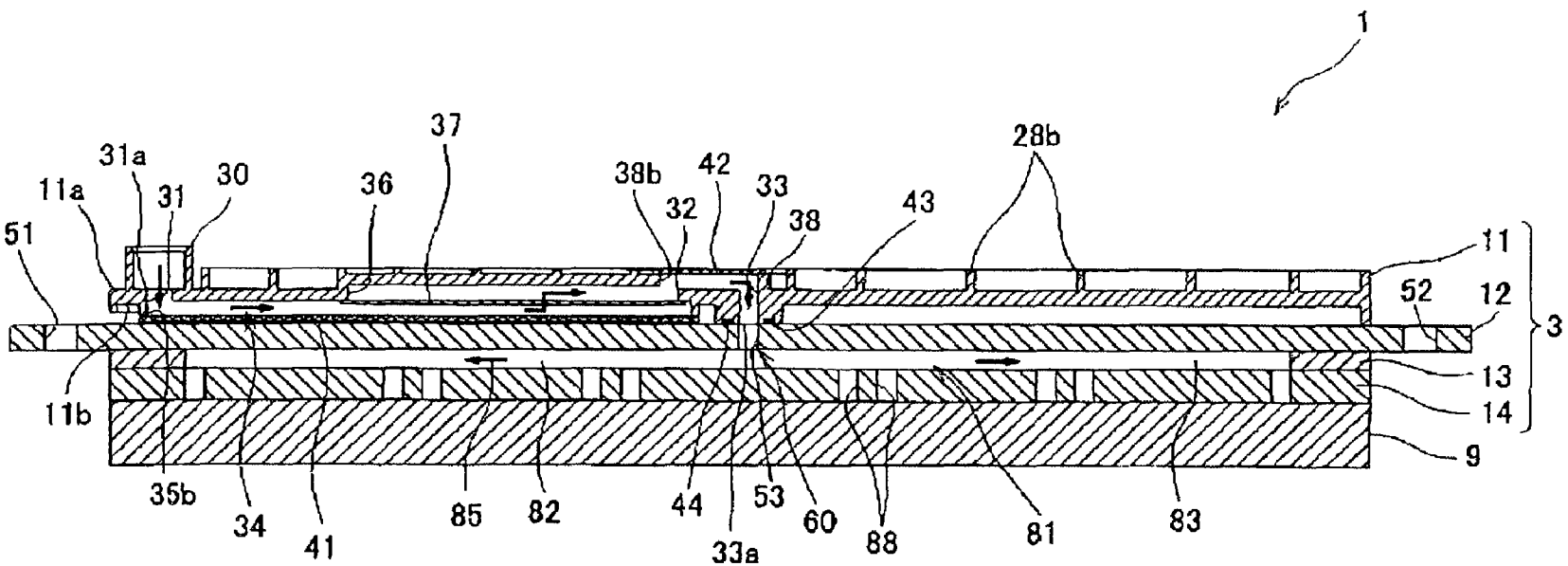
FIG. 2 is a cross-sectional view of the inkjet head of FIG. 1.
Figure 3A:
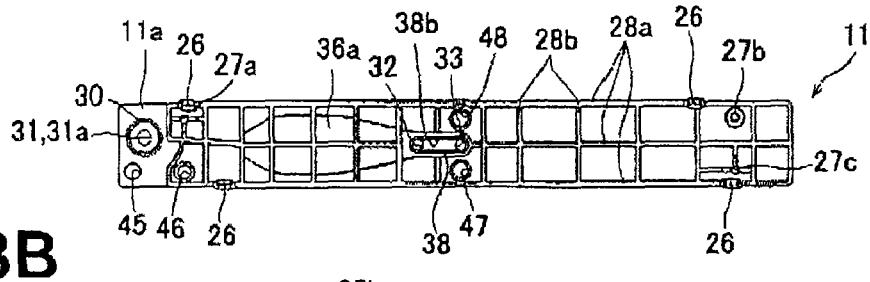
FIGS. 3A-3E are plan, exploded views of a reservoir unit of the inkjet head of FIG. 1.

Referring to FIGS. 3A-3E, the reservoir unit 3 stores ink and supplies ink to an ink flow channel unit 9 which is included in the head body 2. The reservoir unit 3 may comprise three plates 12-14, e.g., metal plates comprising stainless steel or the like. The flow charmer member 11 may comprise a synthetic resin, such as a poly-acetal resin or a poly-propylene resin. Referring to FIGS. 2 and 3A, an ink inflow hole 31 may be formed in the vicinity of a predetermined end in the longitudinal direction (main scanning direction) of the flow channel member 11, and a communication port 32 and a communication hole 33 may be formed in the vicinity of the center in the longitudinal direction. A tube-shaped joint portion 30, which surrounds an inlet 31*a* from a peripheral vicinity of the inlet (first orifice) 31*a* of the ink inflow hole 31 and projects in the upward direction (first direction), may be formed on the surface 11*a* of the flow channel member 11. The joint portion 30 may be connected to a connecting member which is connected to one end of an ink supply tube (not shown), and the other end of the ink supply tube may be in fluid communication with an ink tank (not shown). Thus, ink from the ink tank may be supplied to the ink inflow hole 31 via the joint portion 30. A plurality of ribs 28*a* and 28*b* may be formed on the surface 11*a* and may extend in an upper direction from the surface 11*a*. The rib 28*a* may extend in the main scanning direction, and the rib 28*b* may extend in the sub-scanning direction. The ribs 28*a* and 28*b* may be connected each other and may define a plurality of rectangles in a plan view. Accordingly, the rigidity of the flow channel member 11 may be increased.

Figure 5:
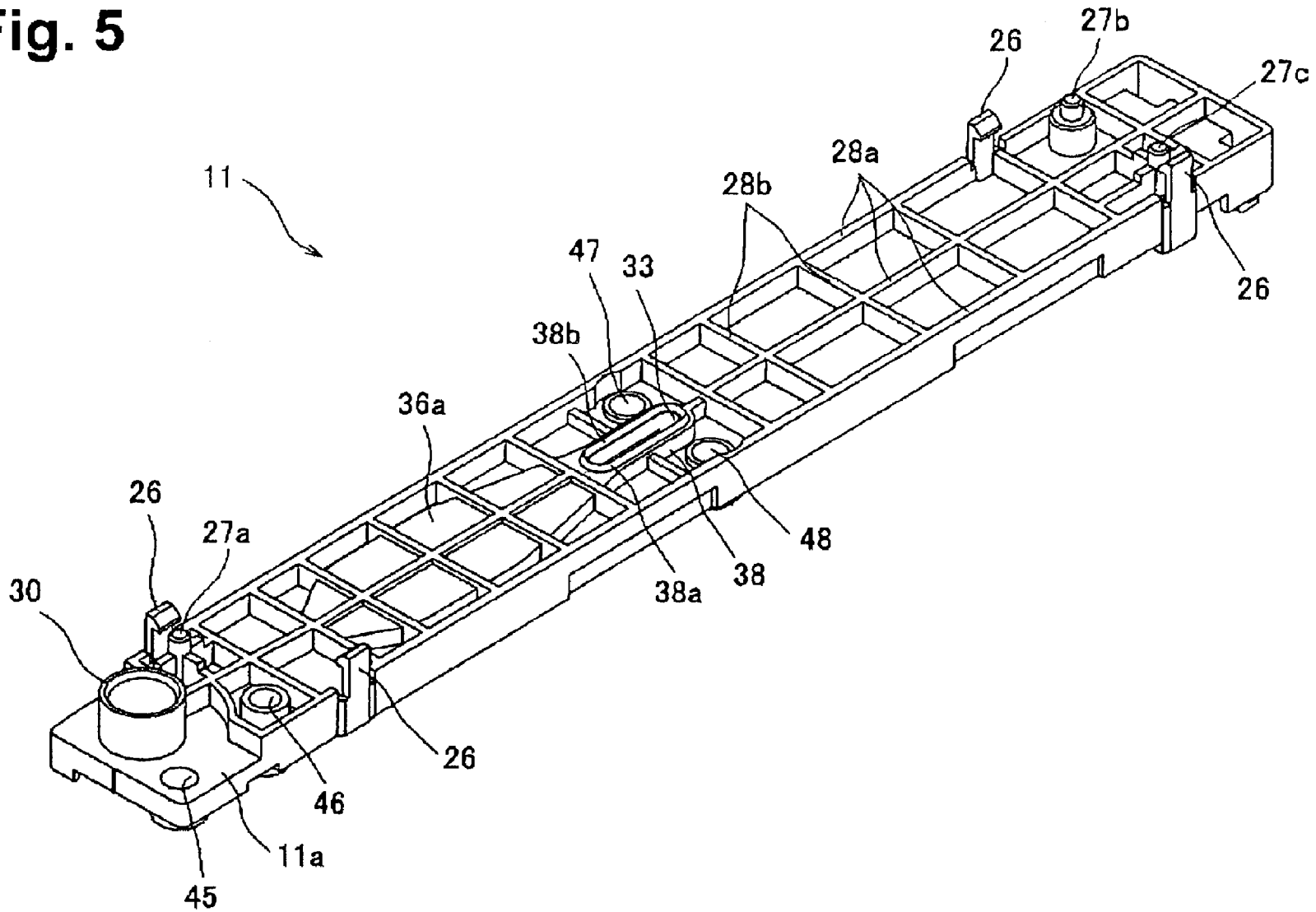
FIG. 5 is a perspective view of the flow channel member of the reservoir unit of FIG. 2, as viewed obliquely from the top.

Referring to FIGS. 3A and 5, a second ring-shaped projection 38 may be formed on the surface 11*a*, may extend in the upward direction (first direction) from the surface 11*a*, and may surround the communication port 32 and the communication hole 33. All end portion of the second ring-shaped projection 38 in the side of the ink inflow hole 31 may be integrated with a bottom portion 36*a* of a concave portion 36. The plane shape of the second ring-shaped projection 38 may be substantially oval, and may extend along the main scanning direction. Referring to FIG. 5, a taper portion 38*a* having a tapered end may extend from the second ring-shaped projection 38. The taper portion 38*a* may be molten by heat over the film (second film) 42, to weld taper portion 38*a* to film 42. Referring to FIG. 3A, an area denoted by hatching in the vicinity of the center of the flow channel member 11 an may be an area welded to the film 42. Thus, a substantially oval orifice (fourth orifice) 38*b* in the ring-shaped area 38 is sealed. At this time, because the end of the taper portion 38*a* is tapered, the front end may be readily molten when heating the front end, such that the film is 42 readily welded by heating the front end of the second ring-shaped projection 38. In addition, even when an error in plane degree occurs in the front end of the second ring-shaped projection 38, the taper portion 38*a* may absorb the error during welding, and the ring-shaped projection 38 may be prevented from melting.

Referring to FIGS. 3A and 5, a latching claw 26 may extend upward relative to the rib 28*a* from each end of the flow channel member 11. The latching claws 26 may push the upper surface of the substrate 4 when the substrate 4 is disposed on the flow channel member 11, whereby the latching claws 26 may be held with the rib 28*a* in the bottom side. A projection 27*a* may be formed on the surface 11*a* in the vicinity of the joint portion 30, and two projections 27*b* and 27*c* may be formed in the vicinity of an end portion opposite to the joint portion 30 of the flow channel member 11. The projections 27*a*-27*c* way be fitted to via holes (not shown) formed in the substrate 4 respectively when the substrate 4 is disposed on the flow channel member 11, e.g., the projections 27*a*-27*c* way match the positions of the flow channel member 11 and the substrate 4.

Figure 3B:
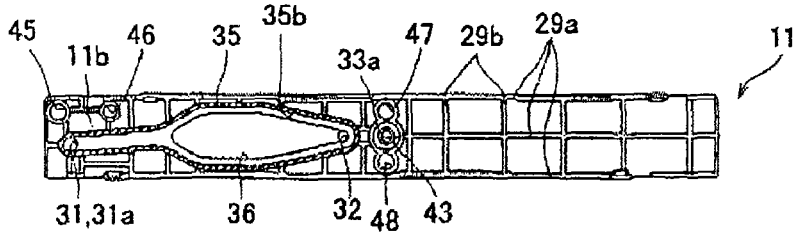
Figure 4:
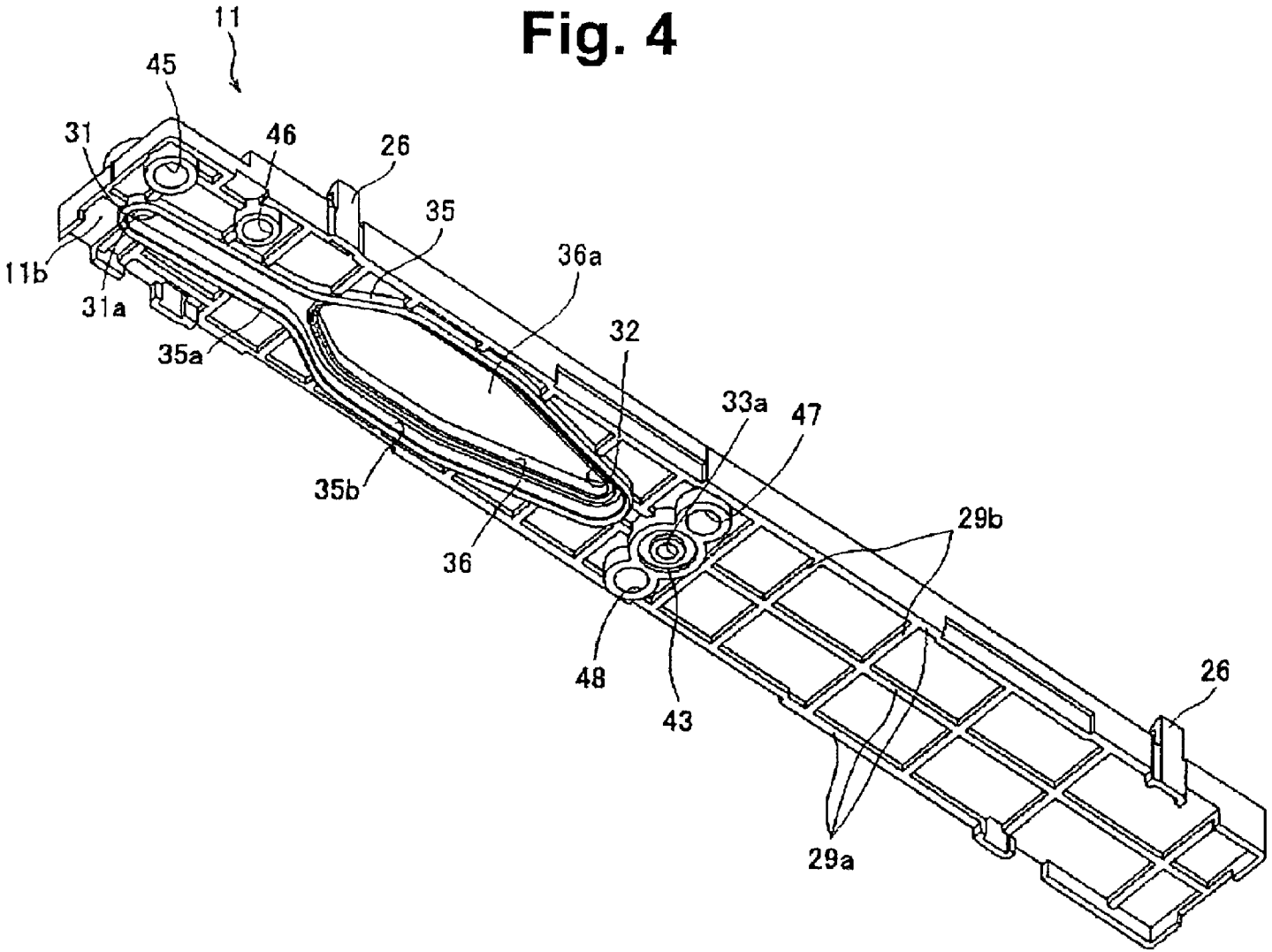
FIG. 4 is a perspective view of a flow channel member of the reservoir unit of FIG. 2, as viewed obliquely from the bottom.

Referring to FIGS. 3B and 4, a first ring-shaped projection 35 may be formed on the opposite surface 11*b* of the flow channel member 11, may extend in the lower direction (second direction) from the opposite surface 11*b*, and may surround the ink inflow hole 31 and the communication port 32. The first ring-shaped projection 35 opens from the opposite surface 11*b* as a bottom surface toward the plate 12. The plane shape of the first ring-shaped projection 35 may extend from the ink inflow hole 31 to the communication port 32 in the main scanning direction, and the center portion of the first ring-shaped projection 35 substantially may be an oval which extends to both ends in the sub-scanning direction of the flow channel member 11. Referring to FIG. 4, a taper portion 35*a* having a tapered end may be formed at the end portion in the direction in which the first ring-shaped projection 35 extends. The taper portion 35*a* may be molten by heat over the film (first film) 41, thereby welding the taper portion to the film 41. Referring to FIG. 3B, an area denoted by the hatching may be an area welded with the film 41. Thus, a substantially oval orifice (third orifice) 35*b* of the first ring-shaped projection 35 is sealed.

At this time, because the end of the taper portion 35*a* is tapered, the front end thereof may be readily molten when heating the front end. Accordingly, the film 41 may be readily welded by heating, the front end of the first ring-shaped projection 35. Consequently, even when an error in plane degree occurs in the front end of the first ring-shaped projection 35, the error may be readily absorbed during welding, and the first ring-shaped projection 35 except the taper portion 35*a* may be prevented from melting.

In addition, a concave portion 36 may be formed in the inner area of the first ring-shaped projection 35 of the opposite surface 11*b*. Referring to FIG. 33, the concave portion 36 extends in the main scanning direction and extends from an original portion where the inner area of the first ring-shaped projection 35 becomes wider in the sub-scanning direction to the communication port 32. Because a size of a plane shape of the concave portion 36 is less than a size of the outer shape of the first ring-shaped projection 35 by one step, they may have similar shapes. In the inner area, the concave portion 36 may be covered by the filter 37. The filter 37 may be fixed in the vicinity of the outer periphery of the concave portion 36, and may be surrounded by the first ring-shaped projection 35 in a plan view. Accordingly, before the orifice 35*b* is sealed with the film 41, the filter 37 may be readily fixed in the vicinity of the outer periphery of the concave portion 36 via the orifice 35*b*.

In addition, a pair of ribs 29*a* and 29*b*, which may be substantially similar to ribs 28*a* and 28*b*, also may be formed on the opposite surface 11*b*. The ribs 29*a* and 29*b* may increase the rigidity of the flow channel member 11. Referring to FIG. 5, the bottom portion 36*a* of the concave portion 36 may extend from the surface 11*a* in the upward direction.

Thus, the ink flow channel (first ink flow channel) 34 from the inlet 31*a* of the ink inflow hole 31 to the outlet (second orifice) 33*a* of the communication hole 33 may be formed in the flow channel member 11 by the film 41 sealing the orifice 35*b* and the film 42 sealing the orifice 38*b*. Referring to FIG. 2, The ink flow channel 34 may extend from the inlet 31*a* in the downward direction to the area opposed to the filter 37. When the flow channel extends from the film 41 toward the filter 37, the filter readily may be fixed to block the concave portion 36. The flow channel via the filter 37, the communication port 32, and the area opposed to the film 42, e.g., third ink flow channel, reaches the outlet 33*a* of the communication hole 33. Thus, ink from the ink tank flows from the inlet 31*a* of the ink inflow hole 31 through the ink flow channel 34, and flows out from the outlet 33*a* of the communication hole 33.

Referring to FIG. 2, a ring-shaped groove 43 opening downward may be formed in the periphery of the outlet 33*a* of the communication hole 33, and an O-ring 44 may be fitted in the ring-shaped groove 43. Referring to FIGS. 3A and 3B, four via holes 45-48 may be formed in the flow channel member 11 and may be in fluid communication from the surface 11*a* to the opposite surface 11*b*. The via hole 45 may be formed of in an end portion (corner portion) of the flow channel member 11 adjacent to the ink inflow hole 31, and the via hole 46 may be formed a position adjacent to the via hole 45. The via holes 47 and 48 may be formed adjacent to the communication hole 33. Any of via holes 45-48 slay be used for fixing the flow channel member 11 to the plate 12, e.g., via a screw.

The orifice 38*b* of the second ring-shaped projection 38 may have an opening area which is less than the opening area of the orifice 35*b* of the first ring-shaped projection 35, such that the film 42 sealing the orifice 38*b* has a plane area which is less than the plane area of the film 41 sealing the orifice 35*b*. The film 41 and the film 42 may comprise a material, e.g., a silica film ($SiO_x$ film) or an aluminum-deposited PET (polyethylene-terephthalate) film, having a flexibility and a gas-barrier characteristic, and the outer gas of the inkjet head 1 may not substantially enter into of the ink flow channel 34 of the flow channel member 11 via the films 41 and 42.

The plane shape of the film 41 may correspond to the plane shape of the first ring-shaped projection 35, such as a substantially oval shape. Specifically, a length a in the main scanning direction may be about 65.2 mm, a length b in the sub-scanning direction may be about 15.4 mm, and a thickness t may be about 70 μm. When a positive pressure (maximum pressure at the time of initial charge of ink into the inkjet head 2) of 200 kPa is applied to the film 41, a warping amount w, which may be calculated by using a known formula concerned with requirements for an oval-plate, an outer peripheral fixation, and an uniformly distributed load (200 kPa), may be about 2.99 mm. Nevertheless, in practice, because a plat-shaped plate (second flow channel member) 12 is faced through a gap of about 0.5 mm on a side, that is a lower side, opposite to the flow channel member 11 in the film 41, the film 41 may warp a substantially insignificant amount.

In an embodiment of the present invention, the film 42 may be about 12.6 mm in length a, 2.4 mm in length b, and 70 μm in thickness t, and the film 42 may warp by about 0.002 mm when the positive pressure of 200 kPa is applied to the film 42. Because the film 42 only may warp a substantially insignificant amount, a member for regulating the warp in the film 42 may not be included. Moreover, in an embodiment, the size of the film may not be limited to a particular size as long as its warp amount w is less than or equal to about 0.05 mm when the positive pressure of 200 kPa is applied.

Figure 3C:
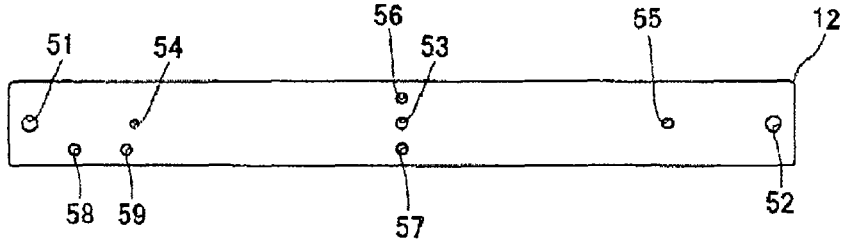

Referring to FIGS. 2 and 3C, a second plate 12 from the top may be longer than the other plates 13 and 14 in the main scanning direction (longitudinal direction) in both sides. Via holes 51 and 52 may be formed in the extended portions of both sides, respectively. The via holes 51 and 52 may be used for fixing the inkjet head 1 to the printer body, e.g., via screws. A via hole 53 may be formed in the center of the plate 12 and positioning holes 54 and 55 may be formed in an approximately center vicinity from the via holes 51 and 52. Further, four screw holes 56-59 may be formed in the plate 12.

The screw holes 56 and 57 may be formed in the center portion of the plate 12 and the screw holes 58 and 59 may be formed in the vicinity of the left end in FIG. 3C. The four screw holes 56-59 may be formed corresponding to the four via holes 45-48 of the flow channel member 11. The screws may be inserted into the via holes 45-48, and the screws may be driven in the four screw holes 56-59, thereby fixing the flow channel member 11 and the plate 12. At this time, the via hole 53 of the plate 12 and communication hole 33 are communicated in correspondence with each other, such that the via hole 53 is the ink flow channel (second ink flow channel) 60 in the plate 12. Because the O-ring 44 is fitted in the ring-shaped groove 43 surrounding the outlet 33*b*, ink between the flow channel member 11 and the plate 12 does not spill out from the outlet 33*b*. Referring to FIG. 1, the screw 25 passing through the via hole 46 passes through a via hole (not shown) formed in the substrate 4. Accordingly, the screw 25 fixes the flour channel member 11 and the plate 12, as well as the substrate 4 and the flow channel member 11.

Figure 3D:
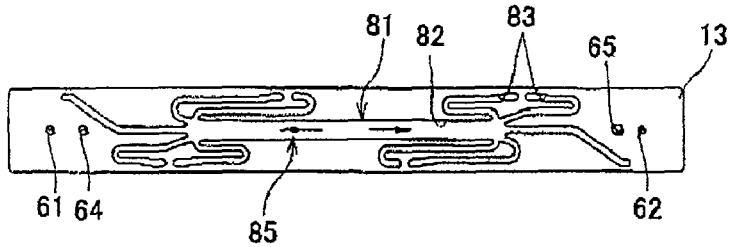

Referring to FIGS. 2 and 3D, a via hole 81 may be formed in a third plate 13 from the top. The via hole 81 may form a reservoir channel 85 including a main flow channel 82 and a plurality of, e.g., ten, branched flow channels 83 which may be in fluid communication with the main flow channel 82. A plane shape of the reservoir channel 85 may be symmetrical about the center of the plate 13. The main flow channel 82 may extend in the longitudinal direction of the plate 13, and the center thereof may correspond with the via hole 53 of the plate 12. For example, five branched flow channels 83 may branch out from both ends of the main flow channel 82. A width of the branched flow channels 83 may be less than a width of the main flow channel 82, and each branched flow channel 83 may have substantially the same flow-channel width and length. Positioning holes 64 and 65 corresponding to the positioning holes 54 and 55 may be formed in the plate 12, and positioning holes 61 and 62 about the plate 14 may be formed in the plate 13.

Figure 3E:
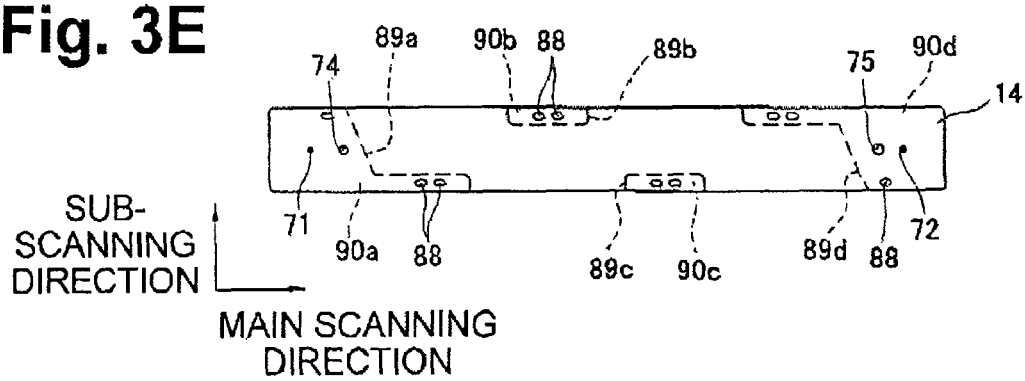

Referring to FIGS. 2 and 3E, each ink outflow hole 88 may be formed in a fourth plate 14 from the top in a position corresponding to the front end portion of each branched flow channel 83. Each ink outflow hole 88 may have an oval shape in a plan view. In the lower surface of the plate 14, in outer peripheral portions (portions surrounded by broken lines) of the ink outflow hole 88, projected portions 89*a*, 89*b*, 89*c*, and 89*d* which extend downward may be formed. Both the projected portions 89*a*-89*d* and the ink outflow hole 88 may be formed by an etching method. The projected portions 89*a*-89*d* may be island-shaped remaining portions when concave portions are formed by a half-etching of the lower surface of the plate 14. Moreover, because the projected portion 89*a*-89*d* are integrated with the plate 14, the projected portions 89*a*-89*d* may not need to be provided as extra members, and the reservoir unit 3 may be readily manufactured.

In the projected portions 89*a* and 89*d*, three ink outflow holes 88 may be formed in each end portion in the longitudinal direction of the plate 14. Two ink outflow holes 88 may be formed in the center vicinity of the plate 14, as end portions in the sub-scanning direction of the plate 14, in each of the projected portions 89*b* and 89*c*. The projected portion 89*a* and the projected portion 89*d* may have the same shape and may be disposed symmetrically about the center point of the plate 14, and the projected portion 89*b* and the projected portion 89*c* may have the same shape and may be disposed symmetrically about the center point of the plate 14.

The end surface (lower surface of the plate 14) 90*a*-90*d* of the projected portions 89*a*-89*d* may be fixed to the upper surface 9*a* of the flow channel unit 9 and the filter (not shown) disposed on the upper surface 9*a*. In the plate 14, four positioning holes 71, 72, 74, and 75 corresponding to the four positioning holes 61, 62, 64, and 65 formed in the plate 13 may be formed, respectively.

The three plates 12-14 may be positioned by inserting positioning pins (not shown) to the positioning holes 54, 55, 61, 62, 64, 65, 71, 72, 74, and 75, and may be fixed to each other via adhesives. Thus, the reservoir unit 3 may be formed by laminating the flow channel member 11 and the three plates 12-14.

As shown by the black arrow in FIG. 2, ink which flows in the flow channel member 11 from the inlet 31*a* of the ink inflow hole 31 through the joint portion 30 transversely flows along the film 41. The ink rises from an area opposed to the filter 37 toward the filter 37, and passes through the communication port 32. At this time, because the ink flows from the lower position of the filter 37 to the upper position through the filter 37, foreign materials of the ink are caught in the filter 37. When the ink stops flowing, some caught foreign materials are separated from the filter 37 and move away from the filter 37 toward the film 41, which increases the filtering ability of filter 37. The ink passing through the communication port 32 flows transversely along the film 42, reaches the communication hole 33, and flows downward. The ink which flows out from the outlet 33*a* of the communication hole 33 passes through the via hole 53 and drops and enters into the reservoir channel 85. Then, referring to FIG. 3D, the ink flows from the center of the main flow channel 82 toward both ends in the longitudinal direction (both ends in the main scanning direction) thereof. The ink reaching both ends in the longitudinal direction of the main flow channel 82 is divided and flows into the branched flow channels 83. The ink flowing in the branched flow channels 83 passes through the ink outflow hole 88 and the filter (not shown) and flows in an ink supply port 101 (refer to FIG. 6) formed on the upper surface 9*a* of the flow channel unit 9. The ink flowing in the flow channel unit 9 is distributed into a plurality of individual ink flow channels 132 in communication with a manifold flow channel 105. The ink reaches nozzles 108 and is ejected outside. Because the ink flow channels, such as the reservoir flow channel 85 and the ink flow channel 34 are formed in the reservoir unit 3, the ink is temporarily stored.

Next, referring to FIGS. 6 to 9, the head body 2 is described. The head body 2 may comprise the flow channel unit 9 and four actuator units 21 fixed on the upper surface 9*a* of the flow channel unit 9. The actuator unit 21 comprises a plurality of actuators disposed opposed to the pressure room 110, and performs the function of applying an ejecting energy to ink in the pressure room 110 formed in the flow channel unit 9.

Figure 7:
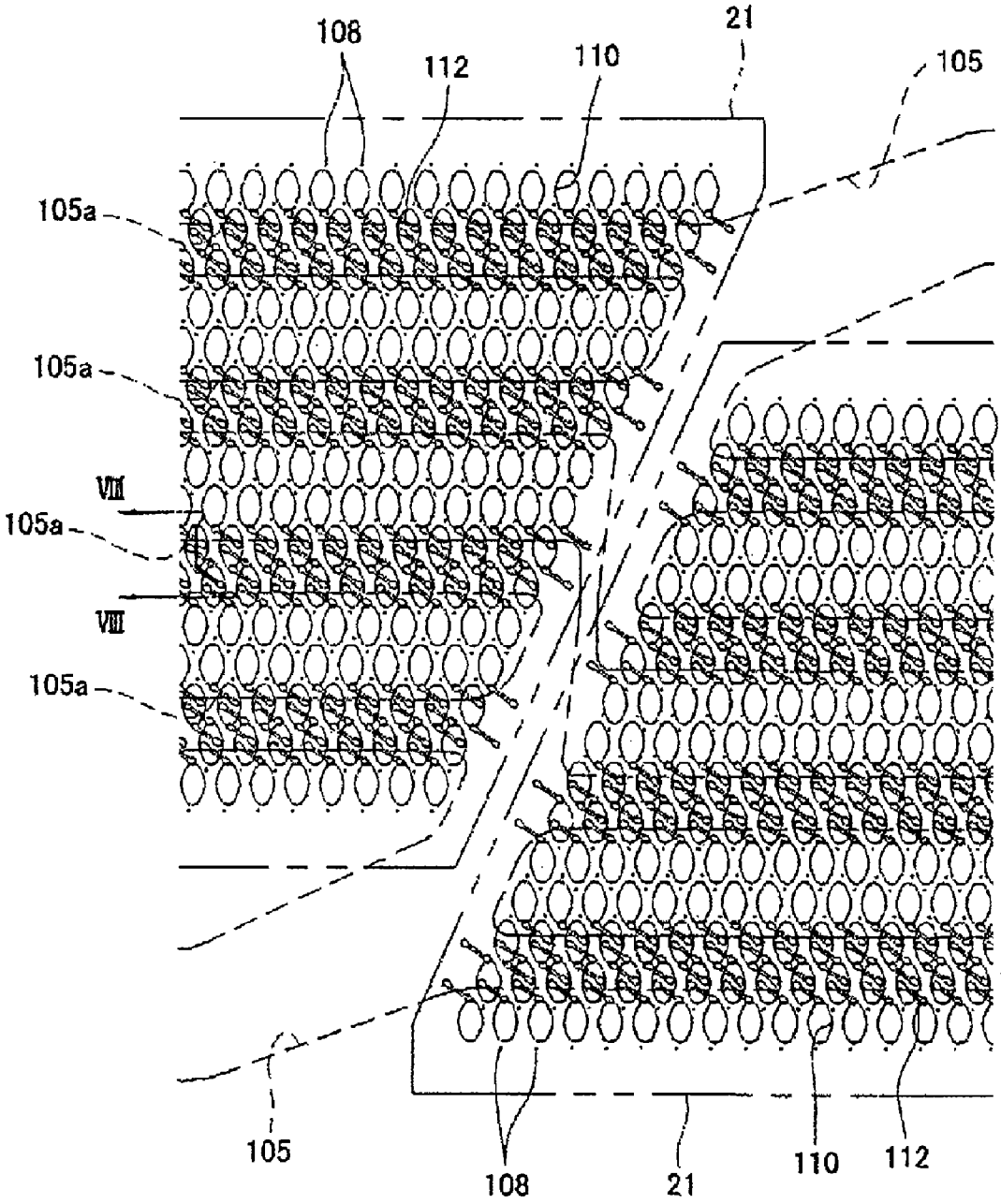
FIG. 7 is an enlarged view of an area of the head body which is surrounded the dashed line of FIG. 6.
Figure 8:
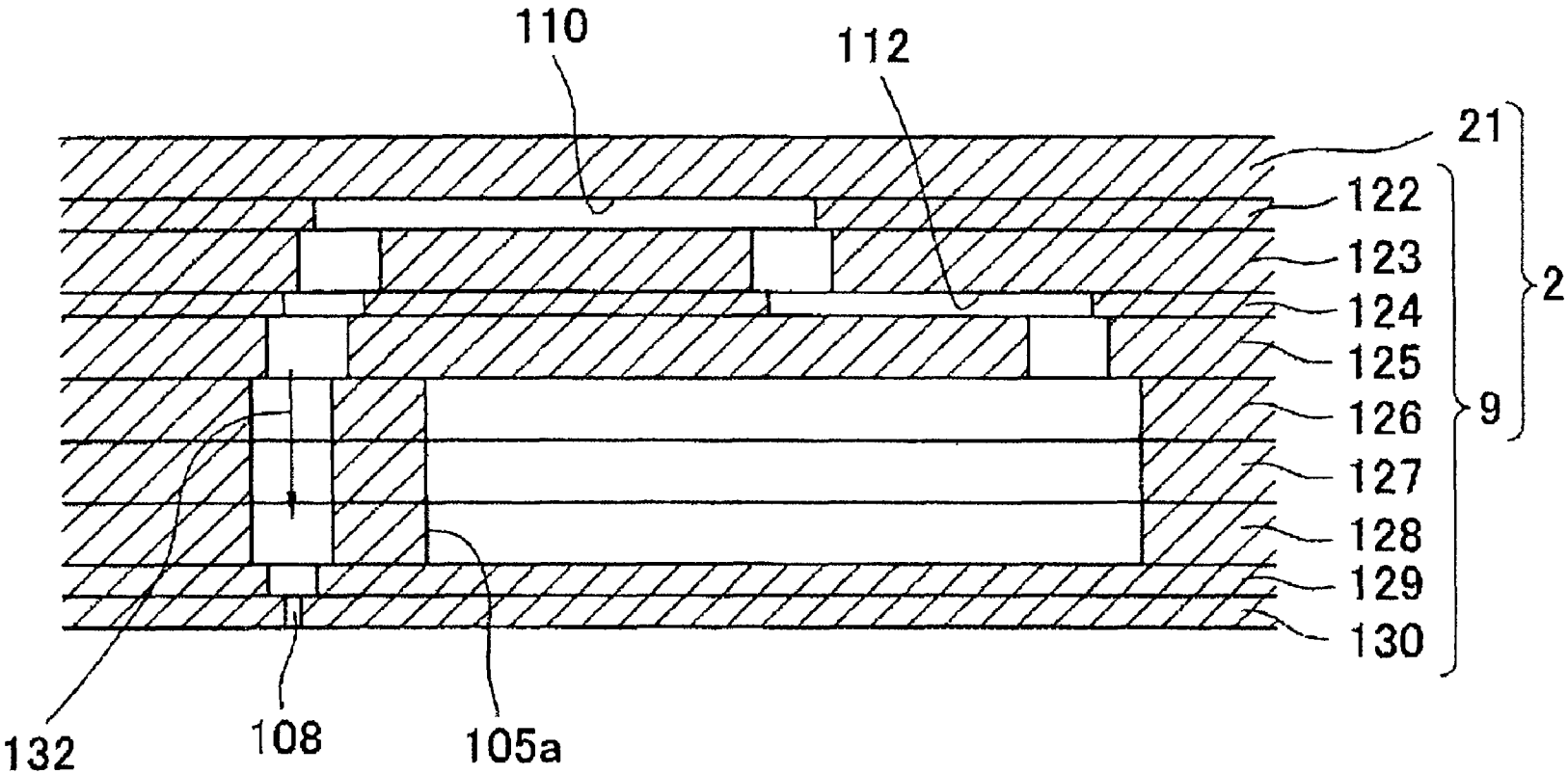
FIG. 8 is a cross-sectional view taken along line VIII-VIII of FIG. 7.

The flow channel unit 9 may have a rectangular shape in a substantially same plane shape as the plate 14 of the reservoir unit 3. Referring to FIGS. 7 and 8, an ink ejecting surface on which a plurality of nozzles 108 are disposed in a matrix manner may be formed on the lower surface of the flow channel unit 9. The plurality of pressure rooms 110 may be arranged in the fixing surface of the flow channel unit 9 and the actuator unit 21 in the same matrix manner as the nozzle 108. Positioning holes 102 and 103 may be formed in both ends in the longitudinal direction (main scanning direction) of the flow channel unit 9, and may be formed in positions corresponding to the positioning holes 61, 62, 71, and 72 formed in the plates 13 and 14, respectively. The flow channel unit 9 and the reservoir unit 3 may be positioned by inserting the positioning pins to the positioning holes 61, 62, 71, 72, 102, and 103.

Referring to FIG. 8, The flow channel unit 9, in order from the top, may be formed of nine stainless metal plates, such as a cavity plate 122, a base plate 123, an aperture plate 124, a supply plate 125, a plurality of manifold plates 126, 127, 128, a cover plate 129, and a nozzle plate 130. The plates 122 to 130 may have a rectangular plane which is longer in the main scanning direction.

A plurality of via holes corresponding to an ink supply port 101 (refer to FIG. 6) and a plurality of substantially lozenge-shaped via holes corresponding to the pressure room 110 may be formed in the cavity plate 122. For each pressure room 110, a connection hole between the pressure room 110 and the aperture 112, a connection hole between the pressure room 110 and the nozzle 108, and a connection hole between the ink supply port 101 and the manifold flow channel 105, may be formed in the base plate 123. For each pressure room 110, a via hole which is an aperture 112, a connection hole between the pressure room 110 and the nozzle 108, and a connection hole between the ink supply port 101 and the manifold flow channel 105, may be formed in the aperture plate 124. For each pressure room 110, a connection hole between the aperture 112 and a sub-manifold flow channel 105*a*, a connection hole between the pressure room 110 and the nozzle 108, and a connection hole between the ink supply port 101 and the manifold flow channel 105, may be formed in the supply plate 125. Moreover, for each pressure room 110, a connection hole between the pressure room 110 and the nozzle 108, and a via holes which are the manifold flow channel 105 and the sub-manifold flow channel 105*a* connected each other at the time of lamination, may be formed in the manifold plates 126, 127, and 128. In addition, for each pressure room 110, a connection hole between the pressure room 110 and the nozzle 108 may be formed in the cover plate 129, and for each pressure room 110, a hole corresponding to the nozzle 108 may be formed in the nozzle plate.

The nine plates 122-130 may be positioned, laminated, and fixed to each other, such that an individual ink flow channel 132 is formed in the flow channel unit 9. In addition, in the embodiment, all the plates 122-130 may be made of the SUS 430 equal to the plates 12-14 of the reservoir unit 3.

Figure 6:
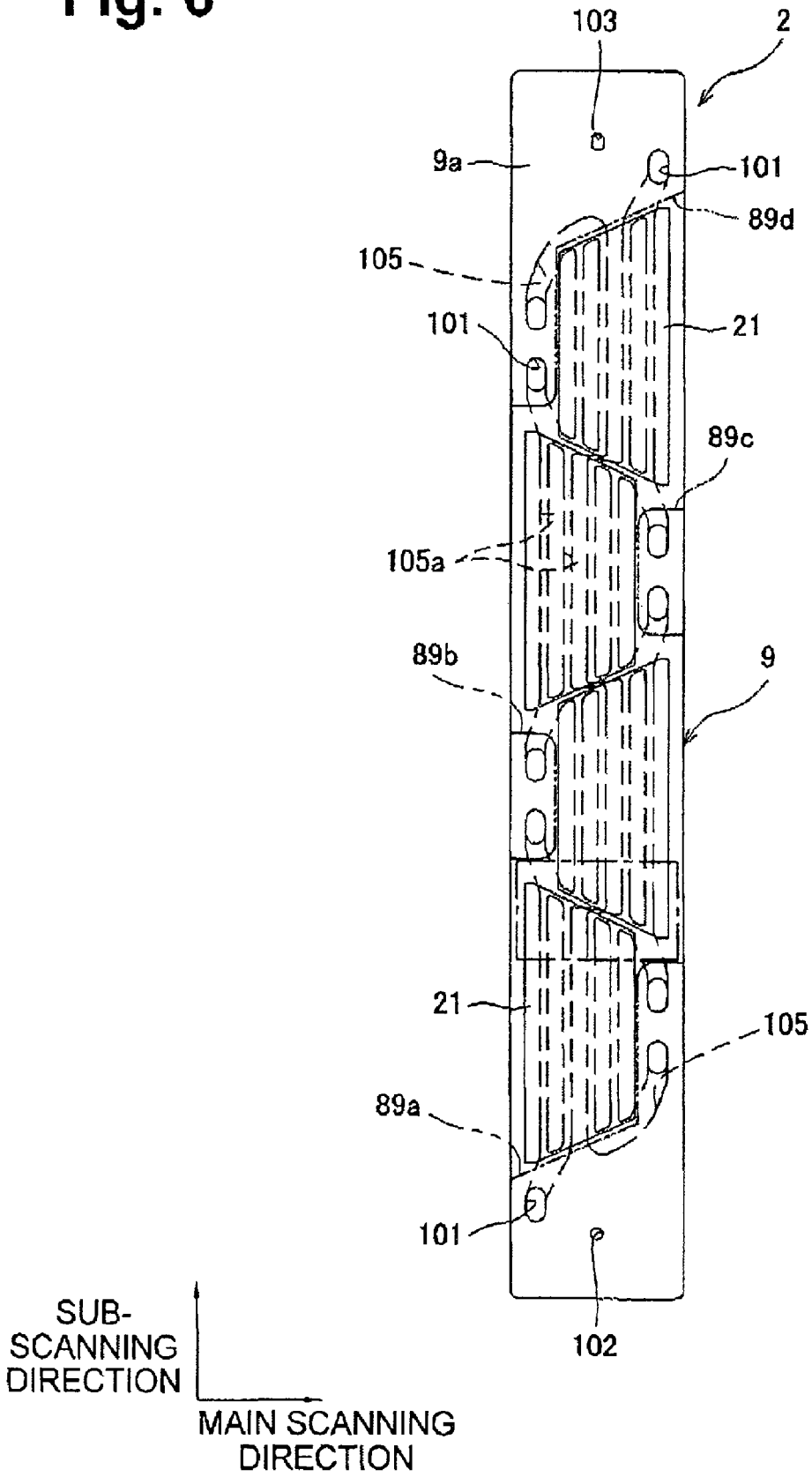
FIG. 6 is a plan view of a head body, according to an embodiment of the present invention.

Referring to FIG. 6, a plurality of, e.g., ten, ink supply ports 101 may be formed on the upper surface 9*a* of the flow channel unit 9 and may open in correspondence with the ink outflow holes 88 (refer to FIG. 3E) of the reservoir unit 3. A manifold flow channel 105 may communicate with the ink supply port 101, and a sub-manifold flow channel 105*a* branched from the manifold flow channel 105 may be formed in the flow channel unit 9. Referring to FIG. 8, an individual ink flow channel 132 from the manifold flow channel 105 to the sub-manifold flow channel and from the sub-manifold flow channel 105*a* to the nozzle 108 through the pressure room 110 may be formed for the nozzles 108. The ink supplied from the reservoir unit 3 into the flow channel unit 9 through the ink supply port 101 may be branched from the manifold flow channel 105 to the sub-manifold flow channel 105*a*, and may reach the nozzle 108 through the aperture 112 functioning as a diaphragm and the pressure room 110.

In the above-described embodiment of the present invention, the plurality of pressure rooms 110 may be arranged in parallel in a regular interval along the primary direction, and may form the pressure rooms of sixteen rows. Each pressure room row may have a number of pressure rooms 110 corresponding to the number of an exterior shape of the actuator unit 21. For example, the actuator unit 21 may have the exterior shape of a trapezoid, and the number of the pressure rooms 10 from the pressure room row corresponding to the longer side thereof toward the pressure room row corresponding to the shorter side thereof may decrease. The nozzle 108 may be disposed as well as the pressure room 110.

Referring to FIG. 6, the four actuator units 21, may have a plane shape of a trapezoid, and may be disposed in zigzags to avoid the ink supply port 101 opening on the upper surface 9*a* of the flow channel unit 9. The above-mentioned ink ejecting surface may be positioned on the lower surface of the flow channel unit 9 corresponding to the contact area of the actuator unit 21. Specifically, the ink ejecting surface on which the nozzle 108 may be arranged in the matrix and a surface on which the pressure room 110 is arranged in the matrix constitute a pair of surfaces opposed to the flow channel unit 9, and a plurality of individual ink flow channels 132 may be formed in the flow channel unit 9 to be inserted to the pair of surfaces. Parallel facing sides of the actuator units 21 may be along the longitudinal direction of the flow channel unit 9, and adjacent oblique sides of actuator units 21 may overlap each other in the width-direction (sub-scanning direction) of the flow channel unit 9. The four actuator units 21 may have a relative positional relationship such as to be away from the width-direction center of the flow channel unit 9 by the same distance in the side opposed each other.

The actuator units 21 may be spaced from the lower surface of the reservoir unit 3 on the upper surface 9*a* of the flow channel unit 9, and may be fixed in the facing portion. As described above, the reservoir unit 3 may be fixed to the flow channel unit 9 by the projected portions 89*a*-89*d* and a gap less than or equal to a projected height of the projected portions 89*a*-89*d* may be formed between the reservoir unit 3 and the flow channel unit 9. The actuator units 21 may be disposed in the gap. Although the FPC 6 may be fixed on the actuator units 21, the FPC 6 is may not contact the lower surface of the reservoir unit 3.

Figure 9A:
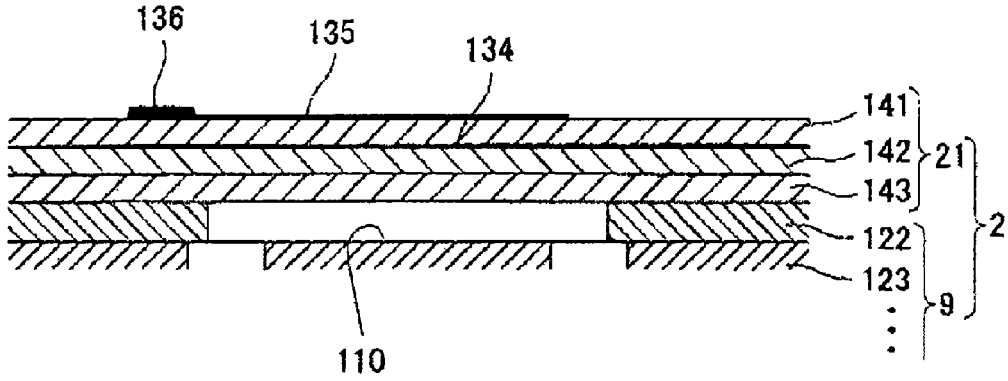
FIG. 9A is an exploded, cross-sectional view of an actuator unit, according to an embodiment of the present invention.

The actuator unit 21 may comprise a ceramic material, such as Lead Zirconium Titanate (PZT) having a ferroelectric characteristic, and may comprise three piezoelectric sheets 141, 142, and 143 having a thickness of about 15 μm (refer to FIG. 9A). The piezoelectric sheets 141-143 may be disposed over the plurality of pressure rooms 110 in correspondence with one ink ejecting surface. The piezoelectric ceramics may be materials having the main constituents such as Lead Niobium Magnesium, Lead Niobium Nickel, Lead Niobium Zinc, Lead Niobium Manganese, Lead Niobium Antimony, and Lead Titanate in addition to the Lead Zirconium Titanate (PZT).

An individual electrode 135 may be formed on the piezoelectric sheet 141 in the top layer in the position opposed to the pressure room 110, and a common electrode 134 may be formed between the piezoelectric sheet 141 and the piezoelectric sheet 142. Both the individual electrode 135 and the common electrode 134, for example, may comprise a metal material, such as an Ag—Pd group metal material. The common electrode 134 may be formed on the substantially whole surface of the piezoelectric sheet 142, and may have a thickness of about 2 μm. Moreover, no electrode may be disposed between the piezoelectric sheets 142 and 143.

Figure 9B:
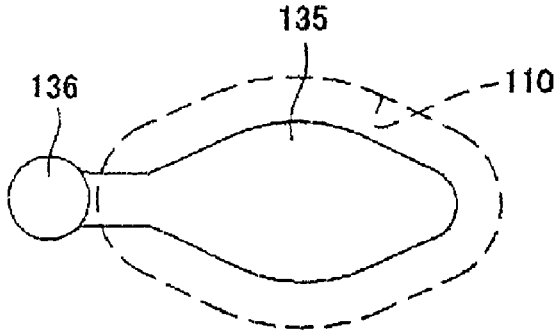
FIG. 9B is a plan view of individual electrodes disposed on a surface of the actuator unit of FIG. 9A.

The individual electrode 135 may have a thickness of 1 μm and may have a substantially lozenge-shaped plane which is the same shape as the pressure room 110 (as shown in FIG. 9B). One acute angle portion in the individual electrode 135 may be extended. A circular land 136 electrically connected to the individual electrode 135 and having a diameter of about 160 μm may be provided on the front end thereof. The land 136, for example, may comprise gold including a glass-frit. Referring to FIG. 9A, the land 136 may be formed at a position located on the extended portion of the individual electrode 135, so as to correspond to the wall defining the pressure room 110 in the cavity plate 122 in the thickness-direction of the piezoelectric sheets 141-143, which is a position which does not overlap the pressure room 110, and is electrically connected to the contact point disposed in the FPC 6 (refer to FIG. 1).

The common electrode 134 may be grounded in the area which is not shown is in drawings. Accordingly, the common electrode 134 keeps uniform ground-electric potential in an area corresponding to every pressure room 110. Moreover, the individual electrode 135 may be connected to the driver IC 7 through the FPC 6, including an independent lead line for each land 136, so as to selectively control electric potential (refer to FIG. 1). In the actuator unit 21, a portion interposed between the individual unit 135 and the pressure room 110 may function as an individual actuator, and a plurality of actuators corresponding to the number of the pressure rooms 110 may be provided.

Herein, a driving method for the actuator unit 21 is described. The piezoelectric sheet 141 may be polarized in the thickness-direction thereof. When the individual electrode 135 has an electric potential different from that of the common electrode 134, and an electric field is applied to the piezoelectric sheet 141 in the polarized direction, a portion, in which the electric field is applied in the piezoelectric sheet 141, functions as an active portion distorted by a piezoelectric effect. Specifically, the piezoelectric sheet 141 is contracted or extended in the thickness-direction, and tends to be contracted or extended in the transverse direction by a transverse piezoelectric effect. Moreover, the two piezoelectric sheets 142 and 143 which are non-active layers not having an area interposed between the individual electrode 135 and the common electrode 134, may not be deformed. When applying the electric field, a difference in distortion between the piezoelectric sheet 141 and the two piezoelectric sheets 142 and 143 is not generated.

In the actuator unit 21, e.g., an unimorph-type, the one upper piezoelectric sheet 141 which moves away from the pressure room 110 may function as a layer including the active portion and the two lower piezoelectric sheets 142 and 143 which are adjacent to the pressure room 110 and function as the non-active layer. Referring to FIG. 9A, because the piezoelectric sheets 141-143 are fixed on the upper surface of the cavity plate 122 defining the pressure room 110, all piezoelectric sheets 141-143 may be convexly deformed (unimorph-deformation) in the direction of the pressure room 110 when a difference in distortion occurs between the electric field applied portion in the piezoelectric sheets 141 and the piezoelectric sheets 142 and 143 thereunder in the transverse direction. Accordingly, a capacity of the pressure room 110 decreases, pressure in the pressure room 110 rises, ink is extruded from the pressure room 110 to the nozzle 108, and the ink is ejected from the nozzle 108. Then, when the individual electrode 135 returns to the same electric potential as the common electrode 134, the piezoelectric sheets 141-143 return to their original plat shape, and the capacity of the pressure room 110 returns to its original capacity. Accordingly, the ink is introduced from the manifold flow channel 105 to the pressure room 110, the ink in the pressure room 110 is stored again, and the desired image is printed on the paper.

According to the inkjet head 1 of the above-described embodiment of the present invention, because a portion of the ink flow channel 34 of the flow channel member 11 is defined by the film 41, the film 41 is warped when the pressure applied to ink in the pressure room 110 is transferred to the ink in the ink flow channel 34 through the individual ink flow channel 132, the manifold flow channel 105, and the reservoir flow channel 85 at the time ink is ejected from the nozzle 108. Accordingly, vibration of the ink by pressure is attenuated.

In addition, even when a negative pressure generated due to the in flowing in the individual ink flow channel 132 is applied to the ink in the ink flow channel 34 through the individual ink flow channel 132, the manifold flow channel 105, and the reservoir flow channel 85 at the time the ink is ejected from the nozzle 108, the film 41 is warped. Because the ink is prevented from vibrating or the amount of vibration of the ink is substantially reduced due to the warping of the film 41, the ink may smoothly flow in the flow channel. Accordingly, a fluid cross-talk may be suppressed, thereby stabilizing an ejecting characteristic of ink.

Because the film 41 opposed to the plate 12 seals the orifice 35*b* through a predetermined gap, the film 41 may be allowed to properly deform to the degree of the gap, and excessive deformation may be limited by the plate 12 when relatively high positive pressure is applied to the ink flow channel 34 like the initial introduction of the ink. Thus, the attenuation effect to the ink injected may be kept stable, and the head may be minimized. If an orifice and a film equal to the orifice 35*b* and the film 41 are formed on the flow channel member 11, the film may tend to warp toward the substrate 4 at the time of the initial introduction of the ink. Because there is solder for fixing the electronic elements in the lower surface of the substrate 4, prominence and depression may be formed thereon. Moreover, because when the film contacts the lower surface of the substrate 4 the film may be damaged, a distance between the film and the substrate 4 may be maintained to be sufficient to prevent such contact.

Further, because the second ring-shaped projection 38 is formed in the flow channel member 11 and the orifice 38*b* is formed the end portion thereof, the flow channel from the communication port 32 to the communication hole 33 may be readily formed. In addition, because the opening area of the orifice 38*b* may be less than the opening area of the orifice 35*b* the film 42 may warp an insubstantial amount to adjacently dispose the substrate 4 on the flow channel member 11, thereby minimizing the head. Further, because the film 42 may not warp by more than 0.5 mm upwards of the flow channel member 11, the substrate 4 may be adjacently disposed, thereby further minimizing the head. In addition, because the substrate 4 may be adjacently disposed on the flow channel member 11, the head may be minimized.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or from a practice of the invention disclosed herein. It is intended that the specification and the described examples are consider exemplary only, with the true scope of the invention indicated by the following claims.

What is claimed is:

1. An inkjet head comprising:

a first flow channel member comprising:

a first orifice which opens in a first direction, wherein ink flows into the first orifice;

a second orifice which opens in a second direction opposite to the first direction, wherein ink flows out from the second orifice; and a first ink flow channel formed therein, wherein the first ink flow channel extends from the first orifice to the second orifice;

a filter which is disposed in the first flow channel member and extends in a direction substantially perpendicular to the first direction along the first ink flow channel, wherein the filter is configured to filter ink which passes through the first ink flow channel;

a first flexible film which is attached to the first flow channel member and extends in a direction substantially perpendicular to the first direction, wherein the first flexible film seals the first ink flow channel at a position upstream of the filter; and a second flow channel member comprising a second ink flow channel which is configured to be in fluid communication with the first ink flow channel via the second orifice, wherein the first flexible film seals a side of the first ink flow channel opposite from the first orifice in the first direction.

2. The inkjet head according to claim 1, wherein the first ink flow channel holds the filter.

3. The inkjet head according to claim 1, wherein the first ink flow channel is defined by an end portion of a first ring-shaped projection which extends in the second direction.

4. The inkjet head according to claim 3, wherein the end portion of the first ring-shaped projection is tapered.

5. An inkjet head comprising:

a first flow channel member comprising:

a first orifice which opens in a first direction, wherein ink flows into the first orifice;

a second orifice which opens in a second direction opposite to the first direction, wherein ink flows out from the second orifice; and a first ink flow channel formed therein, wherein the first ink flow channel extends from the first orifice to the second orifice;

a filter which is disposed in the first flow channel member and extends in a direction substantially perpendicular to the first direction along the first ink flow channel, wherein the filter is configured to filter ink which passes through the first ink flow channel;

a first flexible film which is attached to the first flow channel member and extends in a direction substantially perpendicular to the first direction, wherein the first flexible film seals the first ink flow channel; and a second flow channel member comprising a second ink flow channel which is configured to be in fluid communication with the first ink flow channel via the second orifice, wherein the first flow channel member further comprises a third ink flow channel which opens in the first direction along the first ink flow channel, wherein an opening area of the third ink flow channel is less than an opening area of the first ink flow channel, and the inkjet head further comprises a second flexible film which is attached to the first flow channel member and extends in a direction substantially perpendicular to the first direction, wherein the second flexible film seals the third ink flow channel.

6. The inkjet head according to claim 5, wherein the third ink flow channel is defined by an end portion of a second ring-shaped projection projecting in the first direction.

7. The inkjet head according to claim 6, wherein the end portion of the second ring-shaped projection is tapered.

8. The inkjet head according to claim 5, wherein a distance from a first position of the second film, in which no pressure is applied to ink in the first ink flow channel, to a second position of the second film, in which a pressure of 200 kPa is applied to ink in the first ink flow channel, is less than or equal to 0.5 mm.

9. The inkjet head according to claim 8, farther comprising a substrate, wherein substrate has a plurality of electronic components disposed thereon, and the first flow channel member is positioned between the substrate and the second flow channel member.

10. An inkjet head comprising:

a flow channel member comprising:

a first orifice which opens in a first direction, wherein ink flows into the first orifice;

a second orifice which opens in a second direction opposite to the first direction, wherein ink flows out from the second orifice; and an ink flow channel formed therein, wherein the ink flow channel extends from the first orifice to the second orifice;

a filter which is disposed in the flow channel member and is configured to filter ink which passes through the ink flow channel; and a flexible film which is attached to the flow channel member, wherein the flexible film seals the ink flow channel at a position upstream of the filter, wherein the flexible film seals a side of the ink flow channel opposite from the first orifice in the first direction.

11. The inkjet head according to claim 10, the filter extends in a direction substantially perpendicular to the first direction along the ink flow channel.

12. The inkjet head according to claim 1, wherein the first flexible film overlaps the filter in the first direction.

13. An inkjet head comprising:

a first flow channel member comprising:

a first orifice which opens in a first direction, wherein ink flows into the first orifice;

a second orifice which opens in a second direction opposite to the first direction, wherein ink flows out from the second orifice; and a first ink flow channel formed therein, wherein the first ink flow channel extends from the first orifice to the second orifice;

a filter which is disposed in the first flow channel member and extends in a direction substantially perpendicular to the first direction along the first ink flow channel, wherein the filter is configured to filter ink which passes through the first ink flow channel;

a first flexible film which is attached to the first flow channel member and extends in a direction substantially perpendicular to the first direction, wherein the first flexible film seals the first ink flow channel at a position upstream of the filter; and a second flow channel member comprising a second ink flow channel which is configured to be in fluid communication with the first ink flow channel via the second orifice, wherein the filter is disposed such that the ink passes through the filter in a direction opposite to the first direction.

* * * * *